US006910282B1

(12) United States Patent
Jokinen et al.

(10) Patent No.: US 6,910,282 B1
(45) Date of Patent: Jun. 28, 2005

(54) METHOD AND APPARATUS IN THE DRYING SECTION OF A PAPER MACHINE OR THE LIKE

(75) Inventors: Reijo Jokinen, Raisio (FI); Antti Komulainen, Keuruu (FI); Kari Juppi, Palokka (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/913,901

(22) PCT Filed: Feb. 21, 2000

(86) PCT No.: PCT/FI00/00129

§ 371 (c)(1),
(2), (4) Date: Jul. 16, 2002

(87) PCT Pub. No.: WO00/50692

PCT Pub. Date: Aug. 31, 2000

(30) Foreign Application Priority Data

Feb. 22, 1999 (FI) ..... 990370
Sep. 8, 1999 (FI) ..... 19991908

(51) Int. Cl.[7] ..... F26B 3/00

(52) U.S. Cl. ..... 34/444; 34/456; 34/111; 34/117; 34/635; 34/641

(58) Field of Search ..... 34/444–447, 452–458, 34/111, 113–117, 122, 123, 618, 629, 633, 635, 641

(56) References Cited

U.S. PATENT DOCUMENTS

| | | | | |
|---|---|---|---|---|
| 4,359,827 A | | 11/1982 | Thomas | |
| 4,441,263 A | | 4/1984 | Vedenpaa | |
| 4,669,198 A | | 6/1987 | Wedel | |
| 4,905,380 A | | 3/1990 | Eskelinen et al. | |
| 5,020,242 A | | 6/1991 | Mayer et al. | |
| 5,163,236 A | * | 11/1992 | Heikkila | 34/115 |
| 5,341,579 A | | 8/1994 | Schiel et al. | |
| 5,515,619 A | | 5/1996 | Kahl et al. | |
| 5,535,527 A | | 7/1996 | Virta et al. | |
| 5,782,009 A | | 7/1998 | Kotitschke | |
| 6,317,999 B1 | | 11/2001 | Virta et al. | |
| 6,574,884 B1 | | 6/2003 | Jokinen | |

FOREIGN PATENT DOCUMENTS

| | | |
|---|---|---|
| DE | G 91 10 134.4 | 11/1991 |
| FI | 65460 | 1/1984 |
| FI | 75892 | 4/1988 |
| FI | 82502 | 11/1990 |
| WO | WO 94/03675 | 2/1994 |

* cited by examiner

*Primary Examiner*—Henry Bennett
*Assistant Examiner*—Andrea M. Ragonese
(74) *Attorney, Agent, or Firm*—Stiennon & Stiennon

(57) ABSTRACT

A web (16) running from an opening nip (K1) between a cylinder (10) and a supporting fabric (18) toward a roll (14), is supported by a negative pressure created by a blow box (30). In an intensified negative pressure region (34'), i.e. close to the disengaging point (40) between the supporting fabric and the cylinder, the pressure is greater than at a distance from this disengaging point. The negative pressure is controlled according to parameters which act on the runability of the web and which can be varied, such as web velocity, web solid contents, pulp composition, paper or paper board quality, web grammage, a characteristic of the web, such as porosity, traction acting in the web, or web tension, cylinder temperature, and/or the running situation, such as a web break, a threading situation, or a normal run, so the desired runability is maintained between the cylinder and the roll.

34 Claims, 11 Drawing Sheets

METHOD AND APPARATUS IN THE DRYING SECTION OF A PAPER MACHINE OR THE LIKE

CROSS REFERENCES TO RELATED APPLICATIONS

This application is a U.S. National Stage application of International Application PCT/FI00/00129 filed Feb. 21, 2000 and claims priority on Finnish Application Nos. FI 990370, filed Feb. 22, 1999, and FI 19991908, filed Sep. 8, 1999.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method and a device in the drying section of a paper machine or the like, such as a board machine or a finishing machine.

Then the invention relates particularly to a method and a device in which the web is conveyed, supported by a supporting fabric such as a wire or a felt, over a cylinder, such as a drying cylinder, a roll, or the like, between the cylinder and the supporting fabric, supported by the supporting fabric the web is guided from the opening nip between the cylinder and the supporting fabric toward a roll, such a suction roll, a turn roll, a wire guide roll, another cylinder, or the like, and in which the run of the web from the opening nip toward said roll is supported by a negative pressure created on that side of the wire which is opposite the web.

The invention is particularly intended to be applied in the drying sections of paper, paperboard or finishing machines or the like. The intention is then to be able to apply the invention in drying sections provided with a single wire or a twin wire run, where a wire pocket is formed between two drying cylinders and a roll below them redirecting the wire travel. An intention is also to be able to apply the invention in drying sections provided with a so called inverted run, i.e. in such drying sections where the roll redirecting the wire travel is arranged above the drying cylinders, or in solutions where drying cylinders are arranged above each other on two or more levels. Further the intention is to be able to apply the invention in drying sections provided with combinations of the above mentioned drying sections. The intention is further to be able to apply the invention in suitable respects in other parts of the above mentioned machines.

Previously it has been noted that there is a great need for a negative pressure in the wire pocket, particularly at the opening gap between the drying cylinder and the wire, in order to be able to ensure that the wire comes off from the surface of the drying cylinder. However, increasement of the negative pressure in the whole pocket to the required negative pressure level will cause certain disadvantages. Large amounts of energy must be used when the whole pocket space must be brought to the same high negative pressure level. Large air leaks may make it impossible to reach a sufficiently high negative pressure and to maintain it. So far it has generally been possible to increase the negative pressure sufficiently with the aid of blow boxes.

Further, increasing the negative pressure of the whole pocket to a high negative pressure level may cause other disadvantages. On long wire runs with the length of the pocket height a high negative pressure may bend the wire and the web. Thus the wire can come to touch the surfaces of the blow box or other inflexible surfaces, which causes wire damages and impairs the runability. The central part and edge parts of the web may bend in different ways, which causes stretching in the web. This impairs the runability. Further it has been noted that a high negative pressure at the opening nip may shift the wire disengaging point higher on the drying cylinder.

An aim has been to secure the travel of the web in the opening gap between the drying cylinder and the wire by increasing the draw in the paper web. Draw means that a velocity difference is used to create tension in the web. However, it is not always possible to increase the draw, because a too high draw will decrease the tensile strength of the paper, impair the paper quality, and often impair the runability, i.e. create more web breaks.

Previously it has also been proposed to arrange a special suction box at the opening nip between the cylinder and the wire to create a higher negative pressure. The American patent publication U.S. Pat. No. 5,341,579 proposes to arrange a particular small suction box at the opening nip, with which a certain negative pressure is maintained at this point. The negative pressure at this suction box 20 and the suction roll 12 is created by the same negative pressure blower 32. Thus they can not be controlled separately.

U.S. Pat. No. 5,782,009 presents a suction box mounted in the pocket between two drying cylinders, whereby the suction box is divided into two sections. The suction box section 1 having a higher negative pressure is arranged in the region of the disengaging point between the drying cylinder and the wire. The region is separated from the environment with the aid of mechanical seals. In the cross direction of the web the section 1 with the higher negative pressure can be divided into several parts, where different negative pressures can be created in order to secure the travel of the edges of the web.

U.S. Pat. No. 4,359,827 presents a multi-section suction box arranged in the pocket formed between two drying cylinders. One section of the suction box is arranged in front of the wire at the first drying cylinder regarding the travelling direction of the wire, before the disengaging point between the drying cylinder and the wire. A higher negative pressure is arranged in this section of the suction box than in the other sections of the suction box which border on the wire.

SUMMARY OF THE INVENTION

Thus the particular object of the present invention is such a method and a device, in which the negative pressure in the so called intensified negative pressure region, i.e. close to the disengaging point between the supporting fabric and the cylinder, is higher than the negative pressure in the so called smaller negative pressure region, i.e. at a distance from this disengaging point.

Now it has been surprisingly found that the web to be dried does not in all circumstances result in an optimal running result, despite the higher negative pressure level used at the opening nip. Despite the efforts the web does not always disengage properly from the drying cylinder, or after the disengagement the web may be stretched so that it is not able to follow the wire in a desired way. There occurs web breaks and faults are created in the web.

FIG. 1 shows the forces F acting on the web 16 in the region of the wire pocket 20. At the beginning of the opening nip K1 between the drying cylinder 10 and the wire 18 a high and narrow "force peak" F1 acts on the web, whereby the magnitude of the peak can vary. This peak stretches the web, causing for instance in some conditions a "bubble" in the web, which "bubble" is not anymore able to follow the wire sufficiently well. A weak spot is formed in the web at the location of the "bubble", which impairs the runability of the wire. At other points on the wire run, such as at the closing nip K2 between the wire and the roll 14, the forces F2 acting on the web are substantially smaller as shown in FIG. 1, or they are directed so that they press the web close against the wire.

Thus the object of the invention is to provide an improved method and device in the drying section where the above mentioned problems are minimised.

Then the object is to provide a method and a device, with which the run of the web, particularly at the wire pocket, can be controlled during running conditions.

The object is particularly to provide a method and a device, with which the above mentioned drying section runability problems caused by the behaviour of the web in the opening nip can be minimised in different running conditions.

A further object is to provide a method and a device, with which it is possible to create a suitable level of the higher negative pressure at the location of the above mentioned opening nip.

The respective need for the negative pressure in the drying section of a paper machine, in the pocket space formed between the drying cylinder and the wire, depends generally on many factors, both on the production parameters and the quality of the paper being run.

Now we have found in addition that in some situations for instance the speed of the paper machine, the solid contents of the web, the used pulp quality, the web characteristics, the wire tension, the temperature of the drying cylinder, have a direct effect particularly on that force which is required to keep the web close against the drying wire at the opening nip of the wire, and thus these factors have a particular effect on the runability. Thus a controllable negative pressure is required to disengage the web from the surface of the cylinder at the opening nip, at that side of the web which is opposite the cylinder, in order to compensate for the other varying forces attaching the web against cylinder. It must be possible to control the negative pressure at the opening nip separately from the general negative pressure control in the pocket space.

According to a typical method according to the invention the negative pressure pnip is thus controlled in the intensified negative pressure region of the drying section according to one or more parameters which act on the runability of the web and which can be varied or which vary during the run, such as the velocity of the web,
the solid contents of the web,
the composition of the pulp being used,
the paper or paper board quality which is produced,
the grammage of the web,
a characteristic of the web, such as the porosity,
the draw acting in the web, or the web tension,
the cylinder temperature, and/or
the running situation, such as a web break, a threading situation, or a normal run, so that the web will disengage from the surface of the cylinder in a controlled manner and so that an optimal runability is maintained between the cylinder and the roll.

Thus, according to the invention it is possible to control the level of the higher or intensified negative pressure region according to the parameters defined by the respective run and paper quality. Now it has been noted that it is advantageous to keep the negative pressure in the intensified negative pressure region the higher-the more humid the web,
the higher the running speed,
the hotter the surface of the drying cylinder,
the weaker the web, or
the better runability that is aimed at.

The dry solid contents of the web has an essential influence on the disengagement of the web from the drying cylinder. The more humidity the web contains, the more difficult it has been to disengage the web from the cylinder, and the more difficult it has been to achieve a good runability. Previously it has thus been an aim to increase the dry solid contents of the web to as high level as possible already at the presses, so that the web should have a good runability in the drying section. Regarding the runability it is not necessary to observe, to the same extent as previously, the humidity of the web coming to the drying section, when the invention is applied. With a solution according to the invention even a relatively moist web can be directed from the press to the drying section, because a controlled disengagement from the drying cylinder, which affects the runability, can be secured with a high negative pressure in the opening nip of the drying cylinder. When applying the invention, a humidity can be chosen so that a final product with the desired characteristics is obtained, for instance a bulky product which is only moderately pressed.

In the intensified negative pressure region it is possible to maintain and control a higher negative pressure until the web for instance at a dry solid contents of 65% has reached such a sufficient strength that the higher negative pressure is not required anymore to compensate for the forces which are due to the humid web and which prevent the disengagement of the web. The high negative pressure is maintained and controlled typically at the beginning of the drying section until it is found that the web has dried and/or shrunk so much that the internal tension in the web causes it to disengage in a controlled manner from the surface of the drying cylinder and to follow the wire. Particularly in such cases, where a pulp with very poor quality is used, it may be advantageous to use an intensified negative pressure in the whole drying section.

The invention makes it possible to use threading with a full width in the press and in the drying section. Then the threading at the press is made for instance as follows: The pick-up roll is lowered against the full width web coming from the wire part, and then the full width web is conveyed through the press, supported by the supporting fabric. In the transfer from one supporting fabric to the next in the press the web transfer is aided by a negative pressure. Thus the web is transported with the full width from the press to the first drying cylinder of the drying section. In the drying section the web may be immediately allowed to continue its travel through the drying section so that it has the full width. Then the negative pressures in the pockets between the drying cylinders, both the intensified negative pressure and the negative pressure in the other regions of the pocket must be switched on. A high negative pressure in the intensified negative pressure region attaches rapidly and effectively the arriving full width web to the supporting fabric at each opening nip of a drying cylinder.

On the other hand, the web coming from the press can be first stopped at the doctor blade of the first drying cylinder in the drying section, and then the web is allowed to flow downwards into the pulper or the like below the machine. The passage of the web into the pulper or the like can be assisted by a drop blow arranged in a box or the like in the region of the first pocket of the drying section over the whole width of the web, and by closing the suctions and blows of the box arranged in the pocket as well as the suctions of the first turn roll of the wire.

Then the actual threading of the web through the drying section is made as follows: The press loads are set for the desired line pressure. In the pocket regions the suctions and blows are switched on in the boxes provided with ejection nozzles and/or suction, in the turn rolls or the like, and then the web which has passed over the first drying cylinder is immediately cut with a blow, preferably simultaneously both from the front side and the back side of the machine. The high negative pressure in the intensified negative pressure region, which according to the invention is regulated to be suitable for threading, ensures that the full width web starts to follow the drying wire forwards in the drying section. Thus the web can have the full width when it is guided by the suctions and negative pressures formed in the pockets, up to a desired point in the drying section, and then the forward passage of the full width web can be stopped at a suitable drying cylinder by closing the suctions and blows carrying the web after this cylinder. When the web is stopped a conventional leader can be cut from the web with the aid of an angle cutter, and with the aid of this leader the head of the web can be threaded through the rest of the drying section in a conventional manner.

With the solution according to the invention the web disengagement from a drying cylinder can be secured at different running speeds by controlling the negative pressure pnip in the intensified negative pressure region according to the formula $$\frac{dp}{dx} = \frac{48\mu v R^2}{x^4}$$

where p=pressure x=distance from the disengaging point m=viscosity of the air

V=speed of the web

R=radius of the cylinder.

The formula provides a suggestive value about the negative pressure level. The calculated value can often be higher than the value obtained in practice, as there are restricting factors which affect the negative pressure level in practice. For instance, the maximum level of the negative pressure is determined by the combined permeability of the web and the wire.

The higher the speeds of the paper machine rise the more difficult it will become to control the passage of the web in the opening nip between a drying cylinder and the wire in conventional drying sections, because the web, which is relatively firmly attached to the cylinder surface, will tend to the follow the drying cylinder all the more as the speeds increase. A speed increase of a few hundred meters may require a doubled negative pressure level, for instance from a negative pressure of 500 Pa to a negative pressure of 1000 Pa.

By controlling the negative pressure level in the intensified negative pressure region it is also often possible to use a pulp which is of a lower quality than usually, for instance smaller amounts of chemical pulp, without the runability suffering from this. A part of the fibres may possibly be replaced by a filler which is cheaper than fibre. A part of the additives may possibly be replaced by cheaper additives. A suitably high negative pressure level ensures that the web is disengaged from the drying cylinder.

The paper runability and the efficiency of the drying section can be optimised to a level which is substantially higher than previously, only by controlling the negative pressure level at the opening nip in accordance with the machine speed, the dry solid contents of the paper and/or the paper quality.

When applying the solution according to the invention it is often possible to raise the temperatures of the drying cylinders to a level which is higher than previously, because with a controllable intensified negative pressure it is possible to compensate for the change in the strength of the web due to the higher temperature. When applying the invention it is thus often possible to provide an extra capacity in the drying section, due to the higher temperatures of the drying cylinders.

Previously the difference in the draw, for instance between the press section and the drying section, has been chosen mainly on the basis of the runability. When applying the invention, i.e. when improving the runability at the opening nip with the aid of the negative pressure control, it is possible to choose the tension difference also on other grounds. The choice of the difference in the draw can be made on the basis of the paper quality, the paper characteristics, such as the porosity, the stretch at break.

As the machine speeds increase, the difference in the draw between the press and the drying section in conventional solutions must be increased so much that the quality of the web decreases. A negative pressure control according to the invention makes it possible to keep the difference in the draw at a so low level that the quality characteristics of the web, such as the porosity, will not change over this distance, at least substantially. A typical total difference in the draw, before the web has dried to a solid contents of 65%, can be kept lower than 4.5%, even lower than 3%, when the invention is applied.

Previously it has been necessary to divide the drying section into different groups in order to obtain the required difference in the draw to disengage the web from the drying cylinder in a controlled manner. As in the solution according to the invention it is not necessary to influence the runability in the same amount as previously, a drying group longer than previously can be arranged at the beginning of the drying section.

When applying the invention in fast paper machines with speeds of 1500 to 2500 m/minute, typically about 2000 m/minute, it is thus possible to arrange a single wire run drying group at the beginning of the drying section, the group having typically >8, preferably about 10, or even more drying cylinders. A long drying group saves costs.

In a solution according to the invention there is typically maintained in the intensified negative pressure region a negative pressure level which is >500 Pa, more generally[3] 1000 Pa, but however <20000 Pa, preferably <10000 Pa, depending on the running situation. It is, of course, possible to increase or decrease the negative pressure from the above mentioned values when required. However, the negative pressure level is typically higher than the negative pressure proll, which prevails on the surface of the turn roll of the wire. The negative pressure level in other parts of the wire pocket is considerably lower, i.e. on the level of about 10 to 700 Pa, preferably 100 to 500 Pa, typically 200 to 300 Pa.

The intensified negative pressure region is typically arranged to cover the wire run at the opening nip of the cylinder, so that the intensified negative pressure region begins at a short distance before the actual disengaging point between the cylinder and the wire, and extends the required distance forwards. The greatest need for negative pressure exists particularly at the disengaging point. During the run the disengaging point may move forward or backward, so the blow box must be arranged so that the provision of a sufficient negative pressure is guaranteed during all running conditions. In a drying section provided with single wire run the intensified negative pressure region can typically be a region at the opening nip with a length of typically 50 to 500 mm, preferably 100 to 200 mm. The length of the intensified negative pressure region means the distance in the travel direction of the web between two means, such as seals, throttling means, blow nozzles, between which means there is created a higher negative pressure in the pocket space than in the spaces adjacent to this region.

The region with the intensified negative pressure forms a narrow gap-like region in the cross direction of the web. As the region is small, and the leaks relating to it are small, the negative pressure is easily and at low costs maintained at a desired level. As the region is short in the travel direction of the web, it affects the web and the supporting fabric only during a very short moment, and therefore, despite the high negative pressure, it does not form a harmful stretching or other disadvantageous changes in them.

As seen in FIG. 1, the "force peak" which the negative pressure must overcome, is located in a very limited area. It has been found that the intensified negative pressure region could be located in a region which extends at most 300 mm, preferably 40 to 140 mm, typically 80 mm from the disengaging point between the wire and the drying cylinder in the direction of the opening nip, i.e. in the travel direction of the web. Correspondingly, the intensified negative pressure region would extend at most 300 mm, preferably 40 to 100 mm, typically 70 mm from the disengaging point between the wire and the drying cylinder against the travel direction of the web.

The invention is preferably applied in drying sections where the negative pressure assisting the travel of the web is created with the aid of a blow box, a blow box combination, or a suction box or a suction box combination, extending over the whole width of the web and being arranged in the wire pocket in front of the wire run coming from the drying cylinder. With the aid of the negative pressure created by these boxes the web is kept attached to the wire, even over a desired distance after the opening nip. In conventional drying sections the blow box or the suction box occupies a large part of that pocket, the so called wire pocket, which is formed between two drying cylinders and the turn roll between them, the turn roll being e.g. a suction roll.

A blow box which is suitable for the application of the invention is typically combined with means generating the blowing air, and arranged on that side of the wire which is away from the cylinder, mainly at the opening nip between the wire and the cylinder so that it extends, from the actual disengaging point between the wire and cylinder, a short distance forward in the travel direction of the web. The blow box is typically provided with two nozzles, such as ejection nozzles arranged cross-wise regarding the web's direction of travel and close to wire, or with one ejection nozzle and one sealing means.

The first ejection nozzle or seal is preferably arranged mainly at the opening nip between the wire and the cylinder, however preferably before the actual disengaging point between the wire and the cylinder. The second nozzle or seal may be arranged, in the travel direction of the web, at a distance from the first nozzle and the opening nip, for instance at the closing nip (gap) of the turn roll or the suction roll, or it can be arranged on the other side of the pocket, for instance at the second drying cylinder or at the roll between the drying cylinders.

The ejection nozzles are arranged in the blowing device to blow air jets away from the gap between the blowing device and the wire, so that the air jets discharged from the nozzles prevent extra air from entering the gap and/or suck with their ejection effect air away from the gap between the blowing device and the wire, and thus a negative pressure required to support the web is maintained in the gap.

The actual intensified negative pressure region is provided by dividing the gap between the wire and the blow box into two regions with the aid of a throttling means, an ejection nozzle or the like, and by increasing the negative pressure in the first sub-region of the gap regarding the travel direction of the web, i.e. in that part which covers the area around the disengaging point of the wire. In the second sub-region of the gap it is possible to maintain a substantially smaller negative pressure level.

If the throttling means dividing the gap is simply a mechanical seal, then the negative pressure in the intensified negative pressure region can be controlled for instance by controlling the air flow of the first ejection nozzle. With the aid of the control it is possible to increase or decrease the negative pressure in the intensified negative pressure region. Due to the throttling means, the control does not substantially influence the negative pressure in the other parts of the negative pressure region.

On the other hand, if the throttling means is an ejection nozzle it is also possible to control the negative pressure in the intensified negative pressure region by controlling the air flow of this ejection nozzle. The air discharged by the throttling means from the negative pressure region may be allowed to flow into the rest of the negative pressure region, because the amount of this air is usually small in relation to the size of the negative pressure region, or this discharged air can be guided, immediately after the nozzle, totally away from the negative pressure region with the aid of guide plates or discharge channels.

A blow box suitable for applying the invention is typically connected to means creating a negative pressure, such as to suction channels, and arranged on that side of the wire or the supporting fabric which is away from the cylinder, mainly in the same way as an ejecting blow box. The blow box can be connected directly, and/or via a suction roll which is located between the drying cylinders and which redirects the travel of the web, to means which are arranged outside the pocket and which create a negative pressure. The gaps between the suction box and the wire can be sealed by flexible or deflecting mechanical scaling ledges or ejection nozzles.

The separate sub-region with the intensified negative pressure according to the invention can be created also in other negative pressure regions of the most various kinds which are created with blowing devices. The blowing device can be a blow box which covers a part of the wire run in a drying section provided with a single wire run or a twin wire run, or which e.g. in a paper machine covers some other wire run or felt run where the web is disengaged from the roll and/or is kept attached to the wire with the aid of a negative pressure, and where a smaller negative pressure region provided with an intensified negative pressure is required in addition to the conventional negative pressure.

It is, of course, possible to use a plurality of throttling means, such as e.g. mechanical seals, flow barrer plates or ejection nozzles, in order to divide the negative pressure region between the box and the wire run into more than two different regions. There can be several consecutive negative pressure regions with staggered negative pressures.

The actual blowing device can comprise a single, simple box structure, or it can be formed by a plurality of structural box components. Between the structural box components there can be formed e.g. air channels in order to transport air away from a negative pressure region to another region or to the environment.

The nozzles generating the negative pressure can be simple gap nozzles which are arranged so that the air flowing out from them prevents air from penetrating into the negative pressure region and/or which generates an ejecting effect at a desired point between the box and the wire. Particular ejection nozzles can be advantageously used in the blow boxes, the nozzles being resiliently or pivotally mounted ejection nozzles which, when required, move flexibly away from the wire, when e.g. a paper lump pushes the wire against the nozzle, so that they thus do not break the wire.

In order to guide air away from the intensified negative pressure region the solution according to the invention uses advantageously such surfaces which are convex and which utilising the Coanda effect can controllably direct the air into a desired direction, even outside the intensified negative pressure region. With the aid of surfaces utilising the Coanda effect it is possible to direct the air, which is discharged from the intensified negative pressure region, into the smaller negative pressure region toward the air discharge opening or even into the discharge opening, from which opening the air further can be discharged into a desired space by ejection or by utilising suction.

The negative pressure generated with the solution according to the invention in the intensified negative pressure region can be further intensified by arranging suction creating means in this region. The suction can be created by forming in the blow box a suction opening which is connected to this intensified negative pressure region, whereby the suction opening communicates e.g. via a suction channel with devices creating the suction. It is easy to control the negative pressure level in a simple way with the means which are arranged in the blow box and which create suction. Then it is not necessary to control the ejection nozzles of the box individually, and they can be connected to common means creating the blow.

Suction can be advantageously used particularly when the throttling means is a mechanical limiting means, which itself does not actively and in a controllable manner increase the negative pressure. However, the suction can be used as an addition and to control the negative pressure also in other cases. It is advantageous to arrange a net or the like in front of the suction opening to prevent paper lint coming into the negative pressure region from reaching the suction channels.

In contrast to the case with suction boxes, the box and the wire do not come into mutual contact when suction is used in connection with the blow box solution according to the invention, where air is blown at the location of the means defining the intensified negative pressure region between the wire and the box.

BRIEF DESCRIPTION OF THE DRAWINGS

The invention is described in more detail below with reference to the enclosed drawings.

DESCRIPTION OF THE PREFERRED EMBODIMENTS

Figure 1:
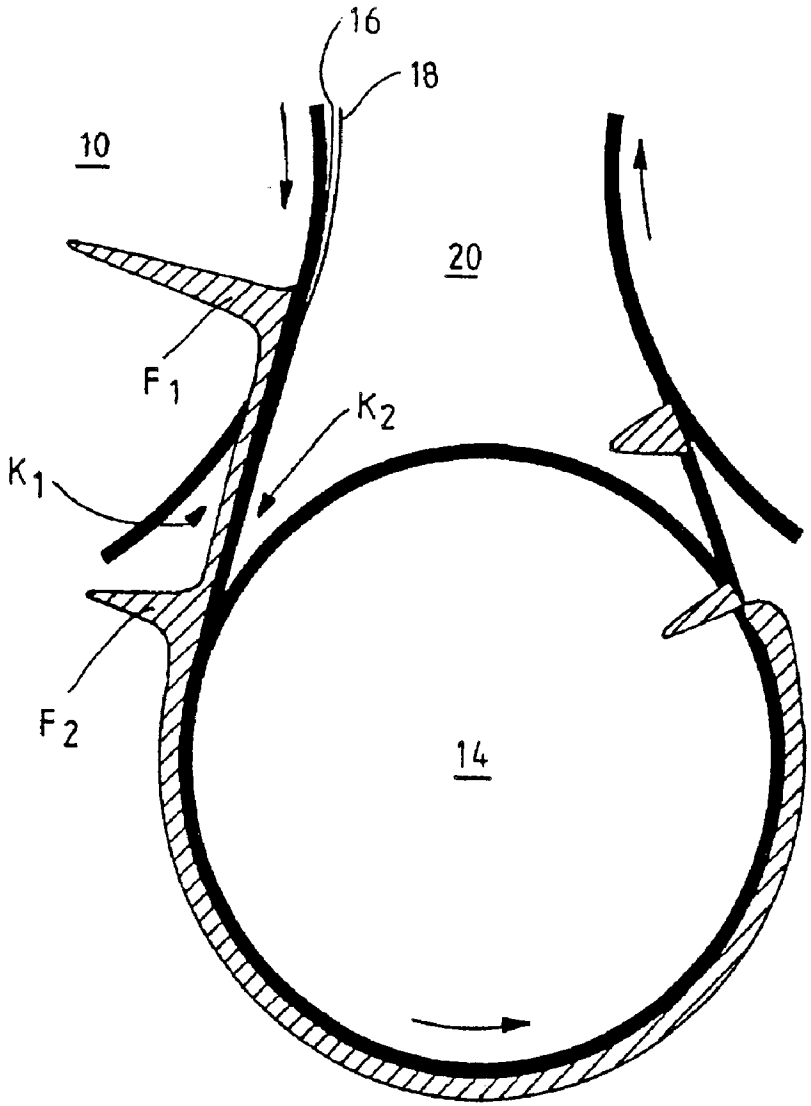
FIG. 1 shows schematically forces which act on the web in the wire pocket region.
Figure 2:
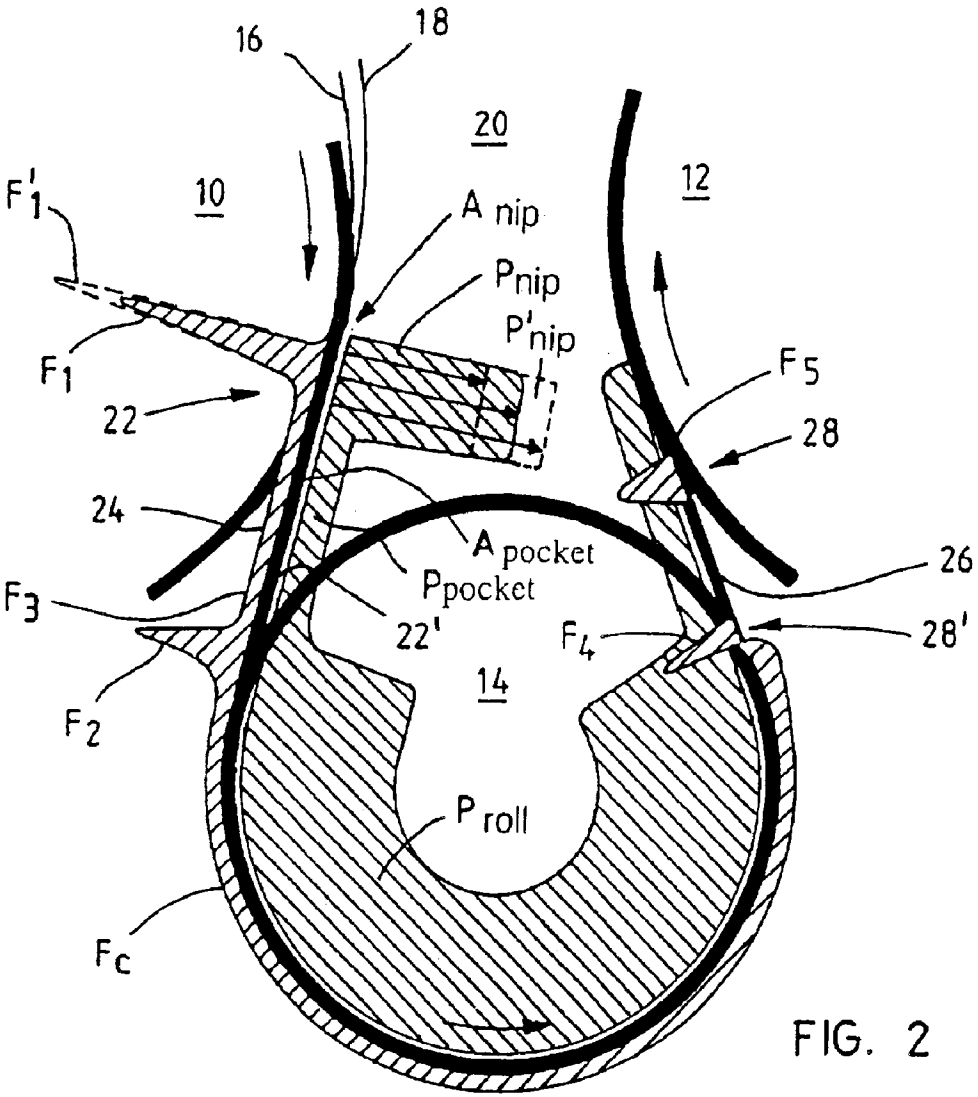
FIG. 2 shows correspondingly negative pressures created with the aid of a solution according to the invention, these negative pressures creating counter forces to the forces occurring in the pocket, as shown in FIG. 1.

FIG. 2 shows a schematic drawing of the forces F acting on the web, and of the negative pressures p compensating for these forces in the pocket 20 formed between the two drying cylinders 10, 12, the turn roll 14, the web 16 and the wire 18. In the case of FIG. 2 the turn roll can be e.g. a perforated or grooved suction roll, in which the negative pressure is provided via the axis at the end of the roll. The negative pressure can be provided in the turn roll also via the peripheral sector adjacent to the pocket space. The turn roll can have a smooth surface or a grooved surface. The paper web 16 runs in a winding manner supported by the wire 18, alternately over a cylinder 10, 12 and alternately over a turn roll 14, so that it forms a pocket 20 between the cylinders and the turn roll.

The wire 18 is disengaged from the periphery of the first cylinder 10 in the so called opening nip 22 and runs to the turn roll 14 so that it forms a so called input wire run 24 between the first cylinder and the turn roll. Correspondingly, the wire runs from the turn roll as a so called output wire run 26 toward the second drying cylinder 12 and passes in the closing nip 28 to run over the second drying cylinder.

At the input side of the pocket there are formed force peaks $F_1$ and $F_2$ disengaging the web from the wire outside the pocket at the opening nip 22 and the closing nip 22'. $F_1$ is substantially greater than $F_2$. Between these forces only a small disengaging force $F_3$ acts on the web. At the turn roll 14 the centrifugal force $F_c$ tends to disengage the web from the periphery of the roll. At the output side of the pocket, in the opening nip 28' and the closing nip 28, force peaks $F_4$ and $F_5$ holding the web are formed.

A blow box or a suction box is mounted within the pocket in order to compensate for the forces disengaging the web, this box creating on the other side of the web a negative pressure which compensates for the forces disengaging the web. At the opening nip 22 there is arranged an intensified negative pressure region $A_{nip}$, where the negative pressure is $p_{nip}$, and in other regions of the pocket a smaller negative pressure region $A_{pocket}$, where the negative pressure is $p_{pocket}$. A suction with the negative pressure $p_{roll}$ is arranged in the turn roll.

When the force $F_1$, which is formed at the opening nip on the input side of the pocket and which disengages the web, changes according to different running parameters, as shown as an example with broken lines, the intensified negative pressure $P_{nip}$ can be correspondingly controlled to a value $p_{nip}'$ so that it in a controlled way compensates for the changed force $F_1'$.

Figure 3:
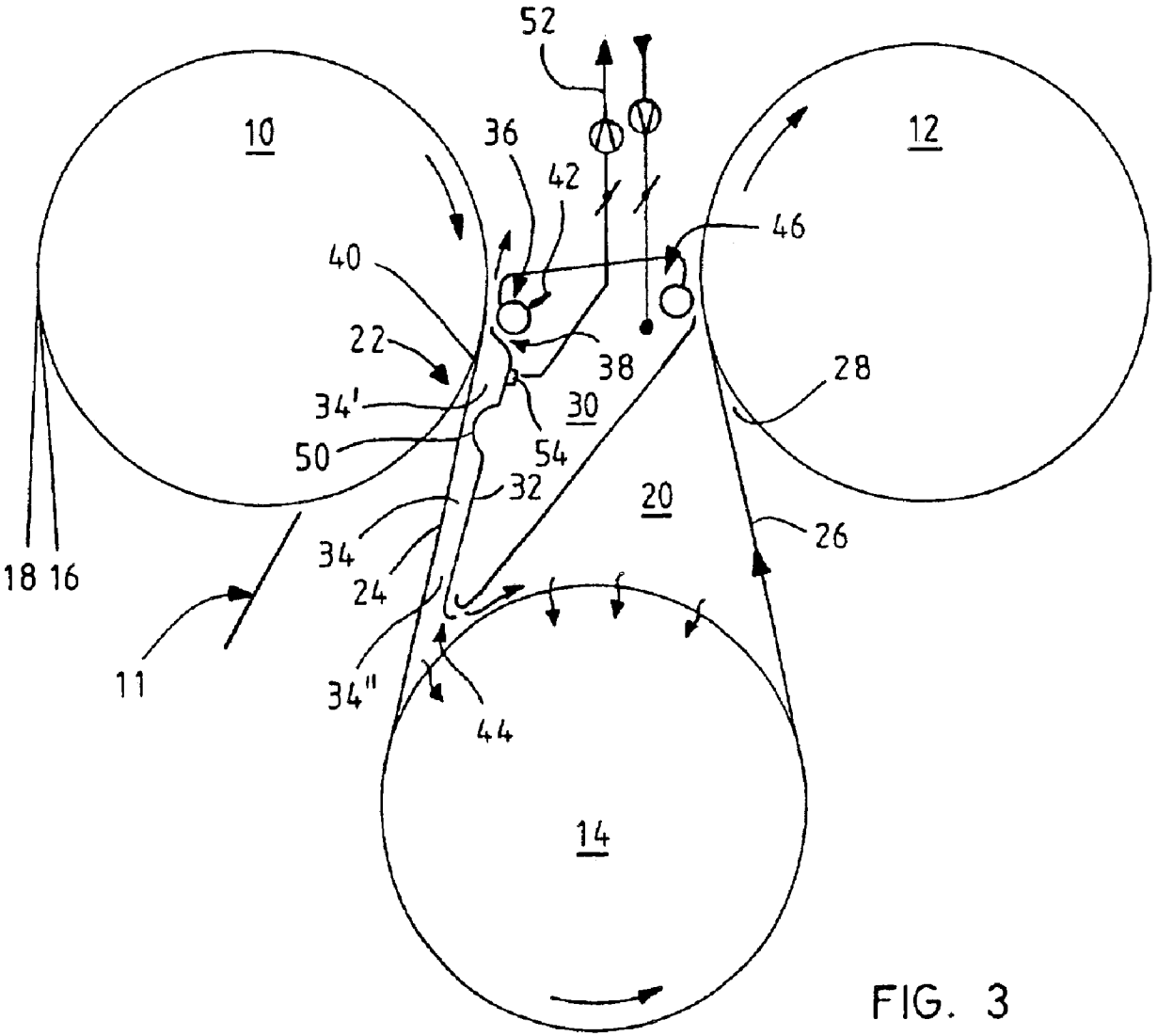
FIG. 3 shows schematically a vertical cross section of the pocket between two drying cylinders in the drying section of a paper machine which is provided with a single wire run, whereby a blow box provided with a controllable intensified negative pressure level according to the invention is arranged in the pocket.

FIG. 3 shows one exemplary solution for maintaining the desired negative pressure level in the pocket 20 between two drying cylinders 10, 12. FIG. 3 uses the same reference numerals as FIG. 2.

In the case of FIG. 3 the blow box 30 extending over the web is mounted in the pocket 20 so that one of its sides 32 together with the input wire run 24 forms a relatively narrow gap 34, in which the blow box creates a negative pressure. In the upper part of the blow box side 32 there is arranged an ejecting blow nozzle 36 which projects from the box 30 toward the wire 18, however without touching the wire. The blow nozzle 36 is arranged in the box above the opening nip 22, i.e. so that air is discharged from the nozzle gap 38 of the nozzle mainly against the travel direction of the wire, and so that the air is discharged at a point which is above the actual disengaging point 40 between the wire 18 and the cylinder 10, i.e. before the disengaging point in relation to the wire travel direction. The air discharged from the nozzle 36 prevents air travelling with the wire from entering the gap 34 between the box 30 and the wire, and further it ejects air away from the gap creating a negative pressure in the gap. The nozzle 36 is fastened to the box with the aid of a spring 42 which presses the nozzle in a suitable manner toward the wire, however so that it enables the nozzle to be pushed into the box, for instance when a paper lump passes the nozzle between the wire and the cylinder. Advantageously the nozzle 36 comprises a Coanda surface known per se, which guides the air flow discharged from the nozzle.

At the other end of the blow box 30, at its lower end, there is formed a second nozzle, a simple gap-like nozzle 44, having air jets which are directed against the rotation direction of the turn roll and which thus prevent air from passing with the turn roll toward the closing nip between this roll 14 and the wire 18. The blows of the nozzle can also eject air away from the gap between the box and the wire. In many drying sections a suction roll, for instance a Vac roll from the applicant, is used as the turn roll, which in the manner shown by the arrows sucks air from the pocket region.

Further, a second ejection nozzle 46 is arranged in the blow box 30 close to the closing nip 28 of the second cylinder 12, slightly after the closing nip, i.e. at a point where the wire is already attached to the cylinder. The air jets of this second nozzle are directed away from the pocket, mainly in the direction of the wire travel. The air jets prevent air from entering the negative pressure pocket through the gap between the nozzle and the wire. In this way a negative pressure can be maintained in the whole pocket.

In addition, it is possible, when required, to mount in the blow box, e.g. above the nozzle 44, a so called drop nozzle (not shown) which blows an air jet directly against the web and thus prevents the web 16 from following the wire 18 to the turn roll 14 at the beginning of the threading phase. The drop nozzle makes the web to pass toward the doctor blade 11 below the cylinder 10, whereby the doctor blade guides the web downwards, for instance to a pulper or the like below the machine.

According to the invention a throttling means 50 is arranged in the blow box at a short distance from the first nozzle 36, the throttling means dividing the gap 34 between the box 30 and the wire 18 into two sections, the section 34' having an intensified negative pressure and the section 34" having a smaller negative pressure. In the case of FIG. 3 the throttling means is a mechanical seal which prevents, or at least reduces, the air flow from the section 34" to the section 34'. The ejection nozzle 36 is in the case of FIG. 3 arranged to remove air from a small part 34' of the pocket 20, whereby it is relatively easy to generate even a very high negative pressure in this small part, compared to the negative pressure in the other parts of the pocket. When desired, it is possible to use another ejection nozzle as the throttling means 50, which actively removes air into the travel direction of the web, so that it assists in generating the negative pressure in the intensified negative pressure region 34'.

In the case presented in FIG. 3 it is thus possible to increase the negative pressure at the wire disengaging point 40 by isolating the gap between the wire and the box in this region from the other regions having a smaller negative pressure. A resilient throttling means or a throttling means fastened resiliently to the box can be arranged in the box so that it projects very close to the wire, even to a distance of <10 mm from the wire, and thus effectively separates the negative pressure region 34' from the rest of the surrounding space. When, in addition, the distance of the nozzle 36 from the wire is short, <20 mm, even <10 mm, and when the air jets from this nozzle are sufficient, we obtain a negative pressure at the opening nip which is sufficient for many running requirements, without any further actions. In other parts of the pocket it is then possible to keep the negative pressure at a substantially lower level, which is sufficient for these regions. In this way wire bending is avoided, and due to this the runability is improved.

The intensified negative pressure in the section 34' assists in disengaging the web from the surface of the cylinder 10, mainly at the wire disengaging point 40, and to attach the web firmly to the wire. The smaller negative pressure in the section 34" is sufficient to keep the web, which already has disengaged from the cylinder, further attached to the wire until the turn roll. Typically suction is arranged in the turn roll in order to keep the web attached to the surface of the turn roll. The suction has also an effect in the pocket. The second ejection nozzle 46 seals the gap between the box and the second drying cylinder and ensures the negative pressure in the pocket, and as well that the web does not form a pouch in the closing nip 28. In the solution according to the invention a relatively low negative pressure, typically 200–300 Pa negative pressure, may be sufficient in other parts of the pocket, except in the gap 34'.

In the solution shown in FIG. 3 the blow box is relatively narrow and occupies only a part of the pocket. A relatively large air space is left between the turn roll and the box. When desired, it is possible to make the blow box structure so large that it occupies almost the whole pocket space and that only a small air gap is left between the lower part of the box 30 and the turn roll. In this case the nozzle 44 can be arranged in the lower edge of the box, on the side of the closing nip, i.e. on the side of the leaving web 26.

A common blowing air supply, or an air supply which is individually controlled at each nozzle, may be arranged for the blow nozzles in the box 30. When the nozzle 36 has its own supply the intensified negative pressure level can be separately controlled with this nozzle. According to the invention the air supply can be arranged so that it depends on those running parameters, in relation to which the negative pressure is intended to be controlled.

In the solution according to the invention it is further possible to form between the nozzle 36 and the throttling means 50 a suction opening 54 connected to the suction channel 52, such as a gap extending across the whole web with which more air can be removed from the intensified negative pressure region through the gap 34', when required.

In front of the suction opening there is advantageously arranged a net or the like which prevents paper lint or other rubbish from reaching the suction channel. The suction channel can be formed so that when a web break occurs the suction channel can be connected to a blower in order to blow air into the gap 34' and to clean the gap.

The suction operation is made possible by the blow nozzle 36, which prevents the supporting fabric and the web to be sucked too close to the box. The blows prevent the supporting fabric from coming into contact with the box structures.

In the solution according to the invention the negative pressure level in the intensified negative pressure region can be controlled in many different ways in addition to or alternatively to the above presented. For instance, the negative pressure level can be controlled by controlling the air discharge through the suction opening 54. Then the air streams blown from the ejection nozzles can even be kept constant, when desired. On the other hand, the negative pressure level can be controlled by controlling the distance of the Coanda surface of the nozzle 36 and/or the throttling means 50 from the web 24, or for instance by controlling the amount of air blown from the ejection nozzle 36.

Figure 4:
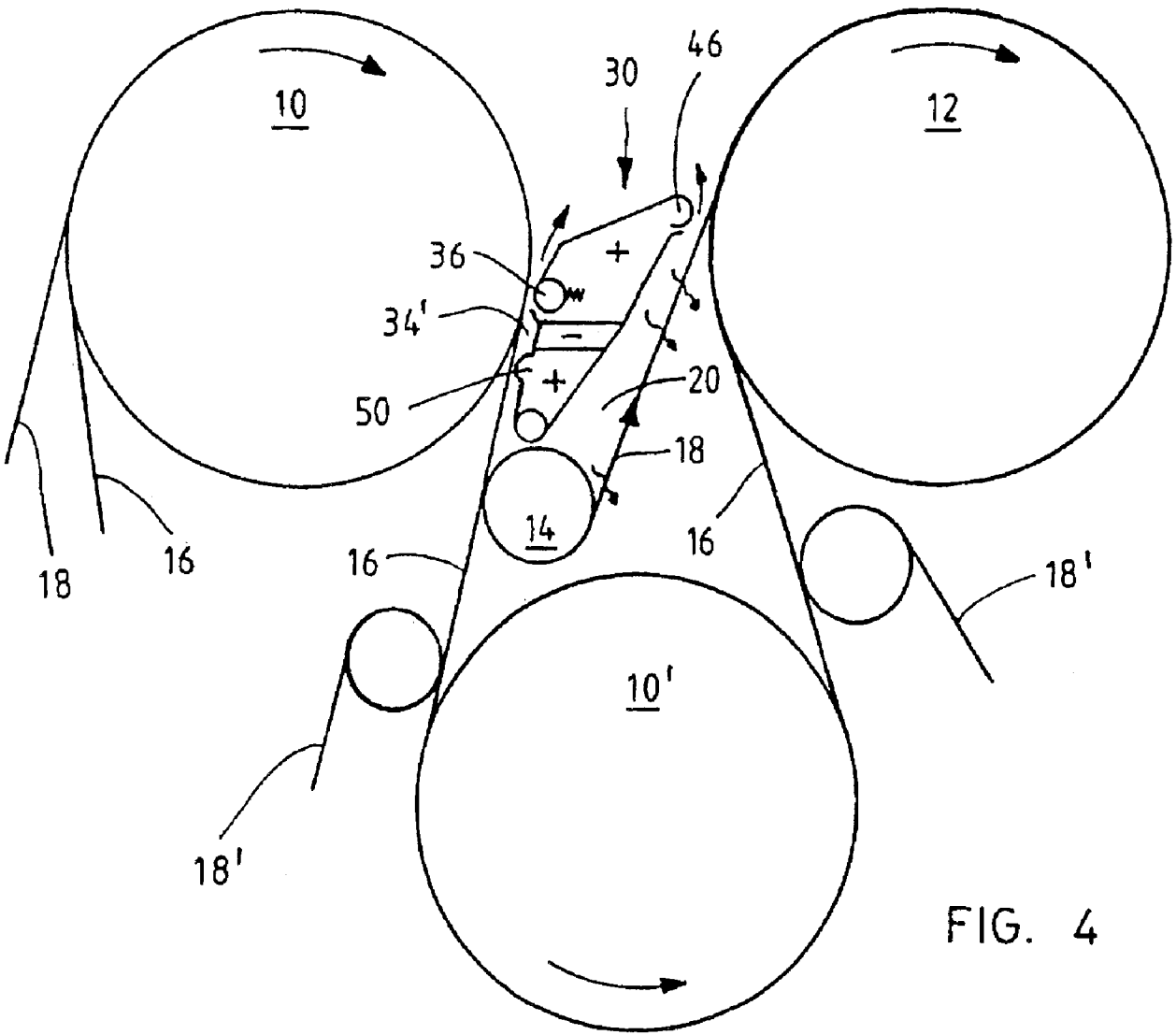
FIG. 4 shows a solution according to FIG. 3 in a drying section provided with a twin wire run.

In FIG. 4 the solution according to the invention is applied in a drying section provided with a twin wire run. The upper wire 18 of the drying section passes in a winding manner from the first drying cylinder 10 via the turn roll 14 to the second cylinder 12. In this way a pocket 20 defined by the wire and the turn roll is formed between the cylinders. In the pocket there is arranged a blow box 30, which is mainly similar to that of FIG. 3, and in which the ejection nozzle 36 and the throttle 50 define an intensified negative pressure region 34' at the wire disengaging point. A second blow nozzle 46 is also arranged in the blow box in order to prevent leaking air from flowing into the pocket space.

A corresponding blow box according to the invention can be used in the drying section shown in FIG. 4, in the region of the lower wire run, for disengaging the web 16 from the lower drying cylinder 10' so that it runs on the lower wire 18' over a short distance.

Figure 5:
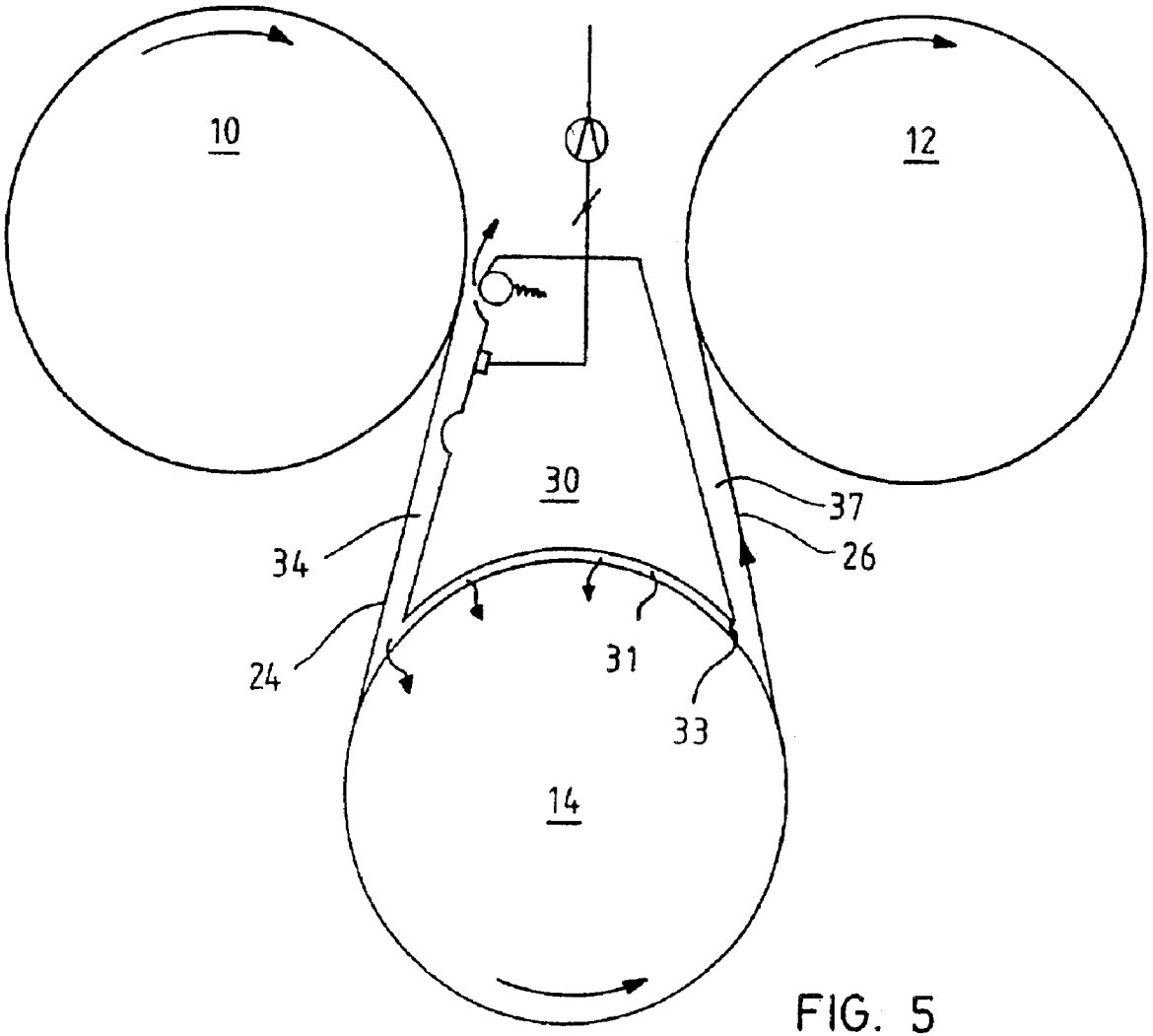
FIG. 5 shows a variation of FIG. 3.

FIG. 5 shows a variation of FIG. 3. Then the same reference numerals as in FIG. 3 are used in FIG. 5, when applicable. The lower part of the box 30 in FIG. 5 is widened so that it covers a large part of the periphery of the turn roll 14. In this way there is a small gap 31 between the periphery of the turn roll and the lower surface of the box. Passage of air along with the turn roll through the gap 31 to the gap 34 on the wire input side is prevented in the case of FIG. 5 by a sealing ledge 33 or the like arranged at the beginning of the gap 31. Then the box has no air blow 44 according to FIG. 3 in the closing nip between the turn roll 14 and the wire run 24. In the case of FIG. 5 there is neither needed an ejecting nozzle between the box 30 and the second cylinder 12. The gap 37 between the output wire run 26 and the box 30 can be made upward widening, whereby air entering the gap is easily removed from the gap. In the case of FIG. 5 the roll 14 is a suction roll which sucks air from the gaps 34, 31 and 37.

Figure 6:
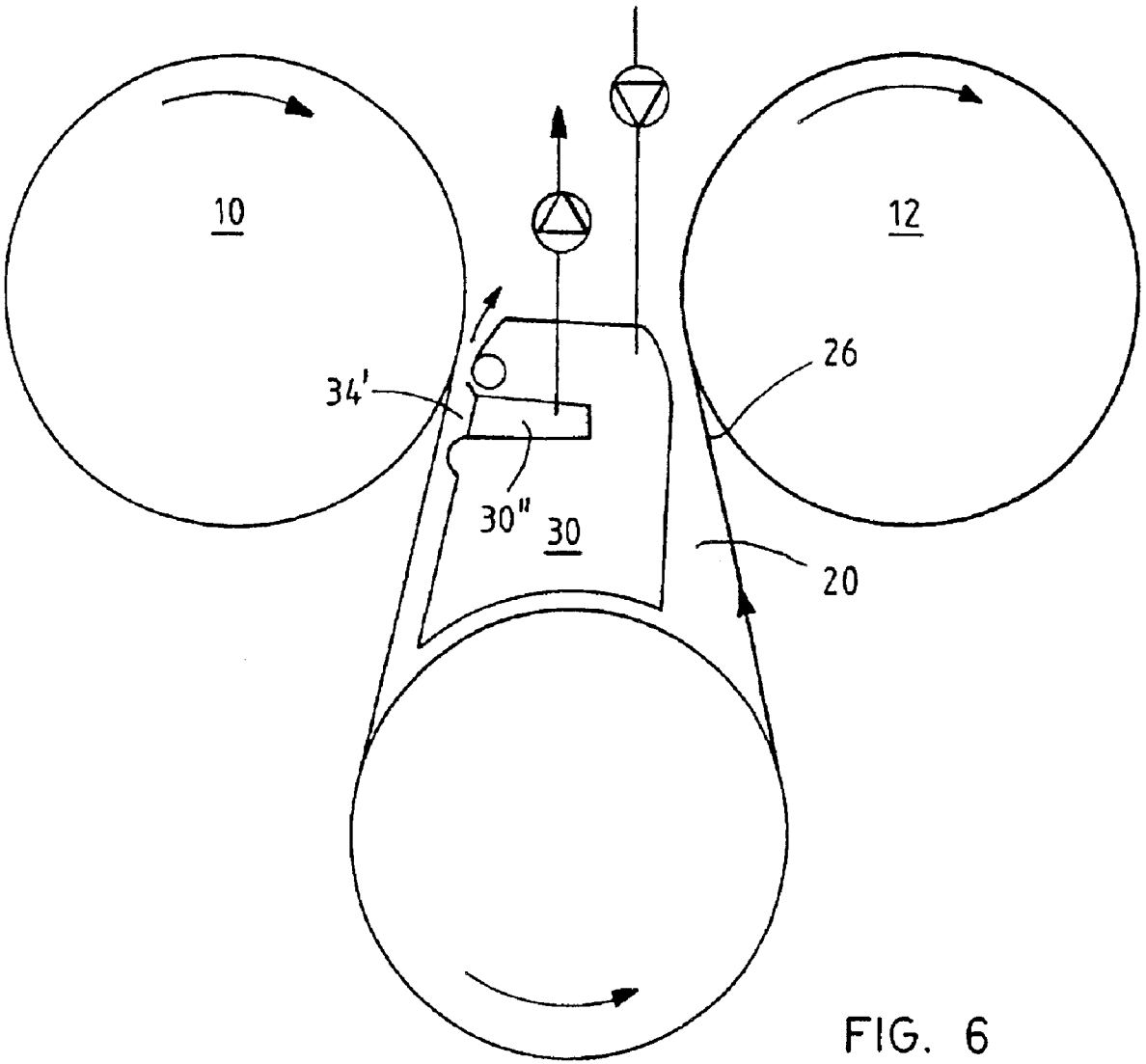
FIG. 6 shows a variation of FIG. 3.

FIG. 6 shows a variation of FIGS. 3 and 5, where the blow box 30 covers a large part of the pocket 20. The first side of the box forms the intensified negative pressure region 34' at the disengaging point between the drying cylinder 10 and the wire. The blow box has a separate suction box 30", having a suction which is directed into the intensified negative pressure region.

The second side of the box 30 further extends very close to the engagement point between the second cylinder 12 and the wire. Only a narrow gap is left between the box wall and the output wire run 26, so that the gap restricts the air flow from the outside of the pocket into the pocket. In this way the desired negative pressure can be maintained in the pocket.

Figure 7:
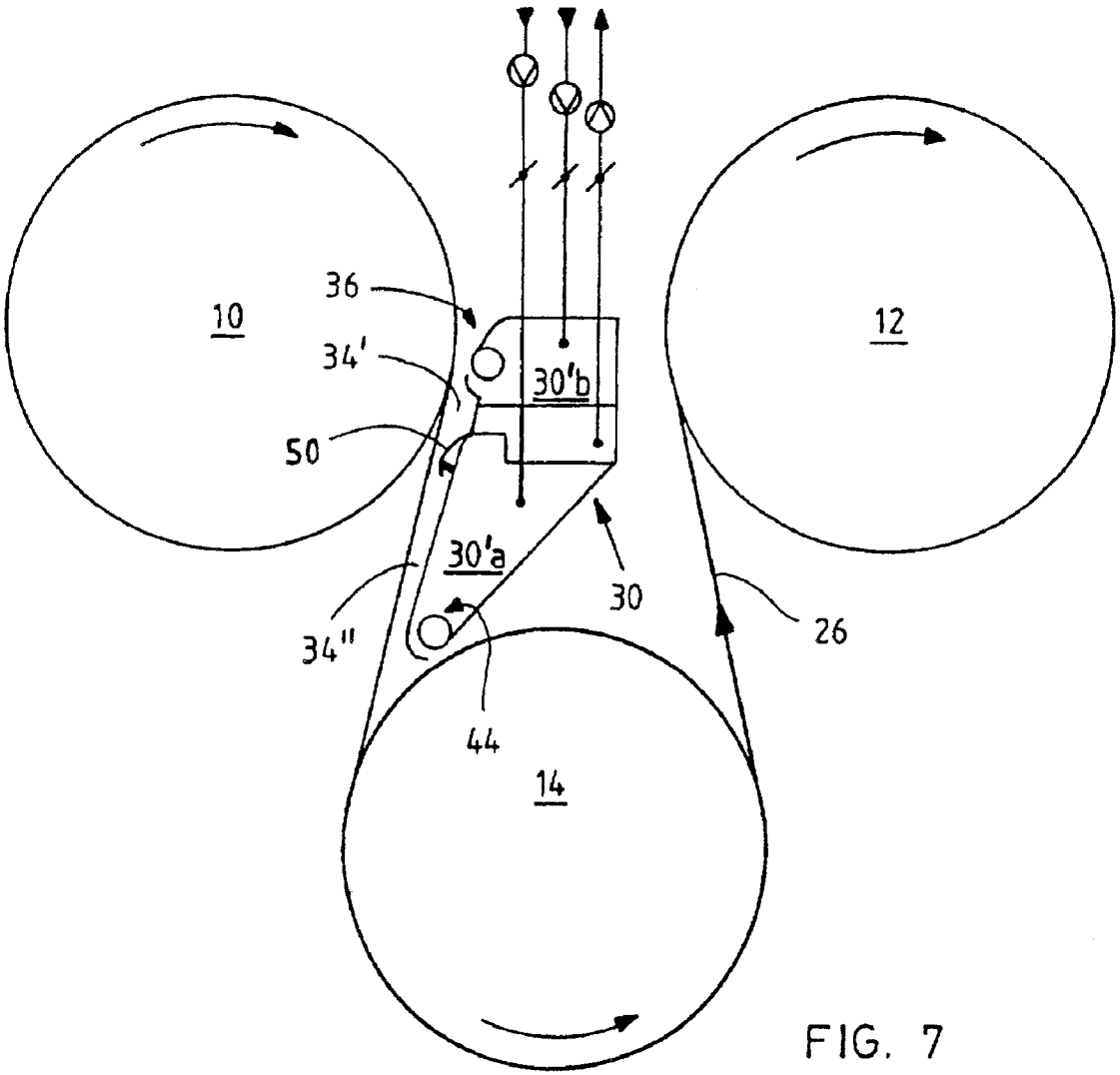
FIG. 7 shows a variation of FIG. 3.

FIG. 7 shows also a variation of FIG. 3. The same reference numerals as in the previous Figures are used in FIG. 7 when applicable. The blow box 30 of FIG. 7 is smaller than the box in FIG. 3, and it does not extend up to the second drying cylinder 12. A box like this can be used, if the negative pressure provided by the box is not needed at the wire run 26 between the turn roll 14 and the second drying cylinder. The nozzles 36 and 44 of the box 30 are connected to different blow chambers 30'*a* and 30'*b*, and they can be separately controllable. A resilient throttling means 50 divides the negative pressure region into two sections 34', 34" where different negative pressure levels can be maintained.

Figure 8:
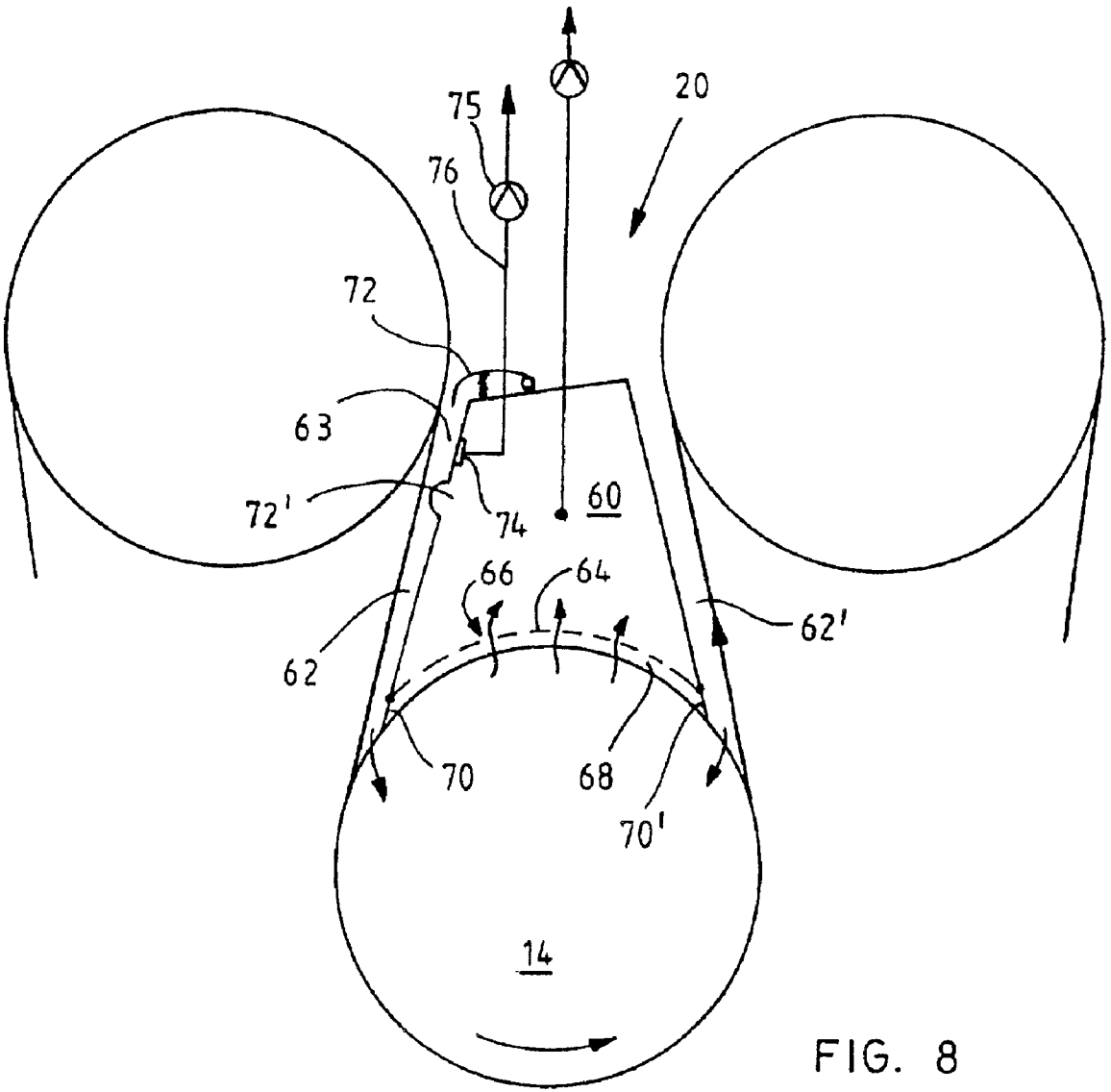
FIG. 8 shows a solution according to FIG. 3, where a blow box provided with a controllable negative pressure level is arranged in the pocket.

FIG. 8 shows still another variation of FIG. 3. The same reference numerals as in the previous Figures are used in FIG. 8 when applicable. In FIG. 8 a suction box 60 with the size of mainly the whole pocket is arranged in the pocket space 20. Narrow gaps 62, 62' are formed between the suction box and the wire runs. The lower part 64 of the suction box having openings 66 is curved so that it follows the form of the turn roll 14, so that a narrow space 68 is left between the suction box and the roll. The edges of the space are sealed at the wire runs with mechanical means 70, 70'. The surface of the suction box is open, e.g. perforated, whereby the suction box can create a negative pressure in the turn roll. The turn roll sucks air from the gaps 62, 62' between the wire runs and the suction box, creating the negative pressure in the gaps required for the travel of the web.

An intensified negative pressure region is formed in the upper part of the input gap 62 by isolating the top part 63 from the gap with sealing means 72, 72' and by connecting this top part of the gap to a suction opening 74, which via the discharge channel 76 is connected to a separately controlled discharge blower 75. An intensified negative pressure level which is optimal for the respective situation can be created in this region of the wire disengaging point, by controlling the air flow discharged from the gap 63, so that this negative pressure level in a controlled way guides the web from the drying cylinder to the turn roll.

It is, of course, conceivable to connect the blow nozzle shown in FIG. 3 to the suction box in order to eject air away from the gap 62.

Figure 9:
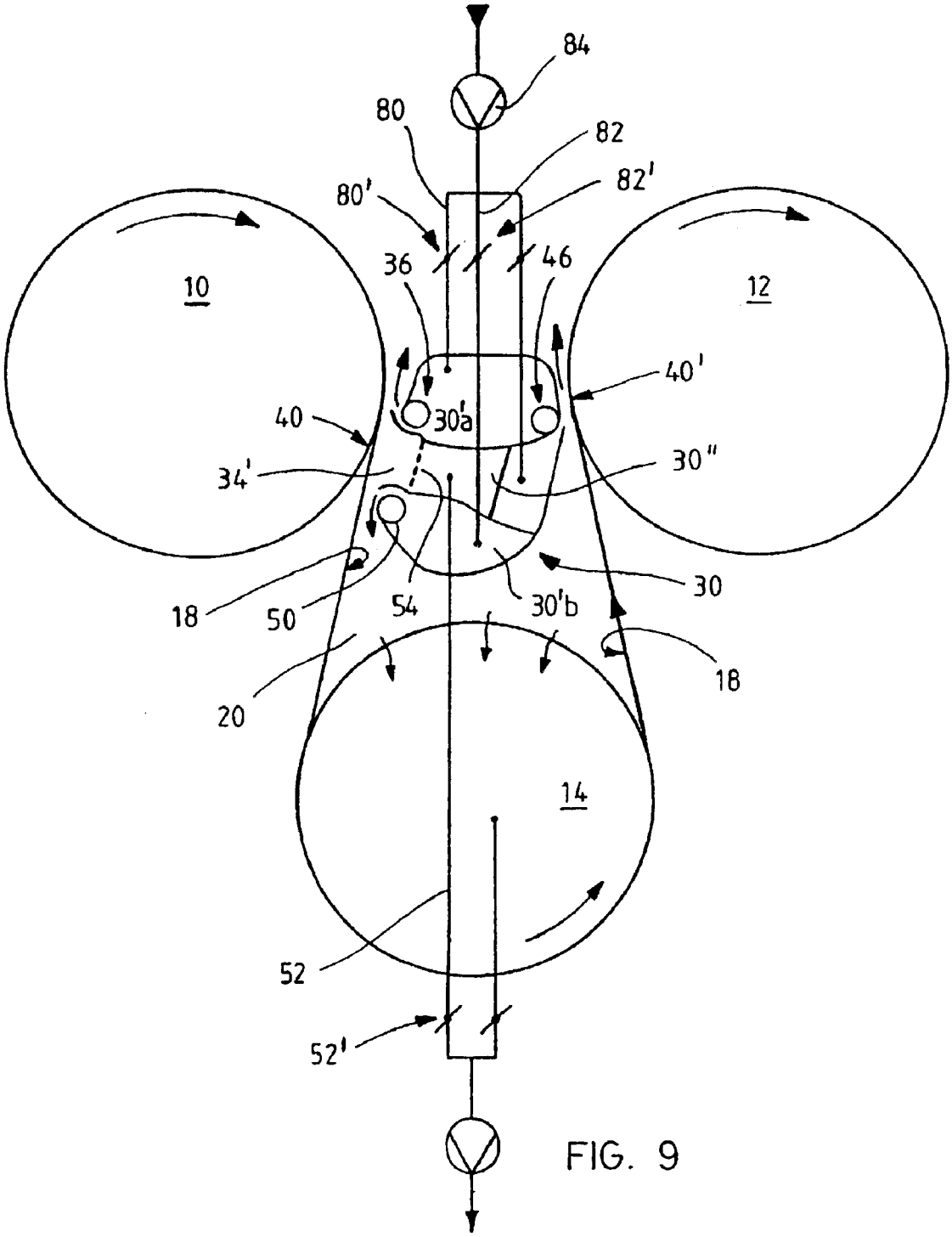
FIG. 9 shows a variation of FIG. 3.

FIG. 9 shows still one variation of FIG. 3. In FIG. 9 there is a box 30 consisting of several sections, where there are two positive pressure box sections 30'*a*, 30'*b* and one negative pressure box section 30", the box sections being mainly mounted between on one hand the disengaging point 40 between the first drying cylinder 10 and the wire 18 and on the other hand the engagement point 40' between the second drying cylinder 12 and the wire, at a distance from the turn roll 14. The box mainly occupies only the upper part of the pocket. The negative pressure is created in the pocket 20 by the suction effect of the roll 14 and additionally by ejection nozzles 36, 46 arranged in the blow box, whereby the ejection nozzles remove air from the pocket, or at least prevent air from entering the pocket.

An intensified negative pressure is created in the intensified negative pressure region 34' by an ejection nozzle 50, which is arranged in the lower section 30'*b* of the blow box, close to the wire and at a short distance from the wire disengaging point 40 in the travel direction of the wire. Air is ejected from the gap 34' between the wire and the box into the lower part of the pocket. The amount of air removed with the ejection nozzle from the gap 34' is small and it does not noticeably influence the negative pressure level in the pocket below the box. Thus air can be removed from the intensified negative pressure region 34' by ejection in two directions. In addition or alternatively, air can be discharged through the suction opening 54 formed in the suction box section 30" and through the discharge channel 52 provided with a control plate. If it is desired to discharge air only with the aid of suction, then the ejection nozzles can be replaced by seals.

Further FIG. 9 shows channels 80, 82 provided with control plates 80', 82', through which air is blown with the aid of a blower 84 into the blow box sections 30'*a* and 30'*b*, which are connected to the ejection nozzles 36 and 50 at the borders of the intensified negative pressure region. The negative pressure in the intensified negative pressure region can be controlled according to the invention with the control plates 52', 80' and 82' shown in FIG. 9, so that the negative pressure has a desired magnitude in relation to the prevailing running situation.

Figure 10:
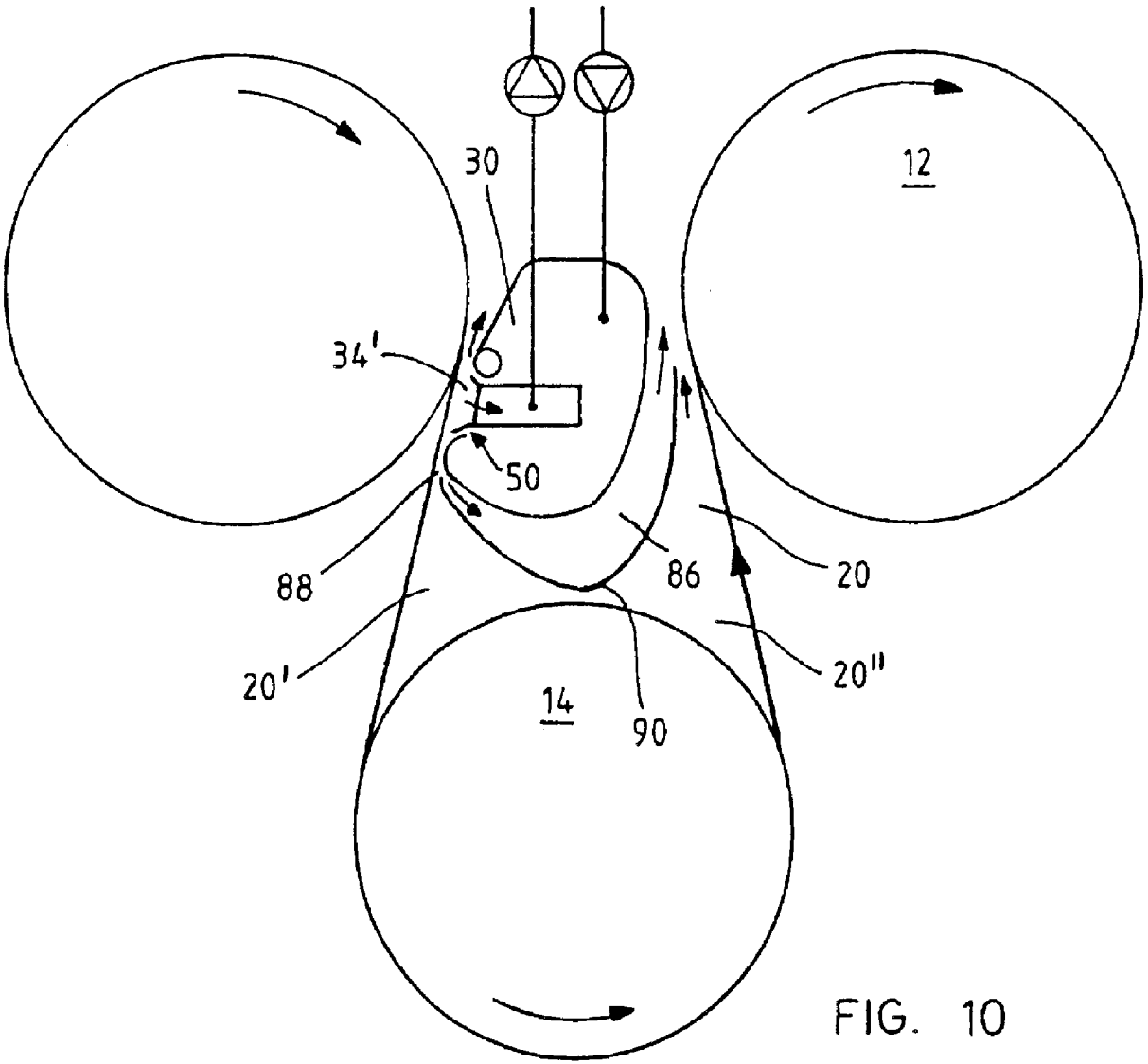
FIG. 10 shows a variation of FIG. 3.

Finally FIG. 10 shows still one variation of FIG. 3. An ejection nozzle 50 is arranged in the blow box of FIG. 10 at the bottom edge of the intensified negative pressure region, so that the ejection nozzle discharges air from the region 34'. The air discharged from the region 34' is directed out from the pocket 20 through the gap between the box 30 and the second drying section 12 with the aid of the channel 86 mounted in the lower section of the box 30. The input opening 88 of the channel 86 is open to the air flow leaving the intensified negative pressure region. In addition the channel 86 is shaped to be curved downwards so that it extends almost up to the surface of the turn roll 14, whereby a narrow space 90 is formed between the channel 86 and the roll 14, the space limiting this air flow in the rotation direction of the turn roll from the output side 20" of the pocket to its input side 20'.

Figure 11:
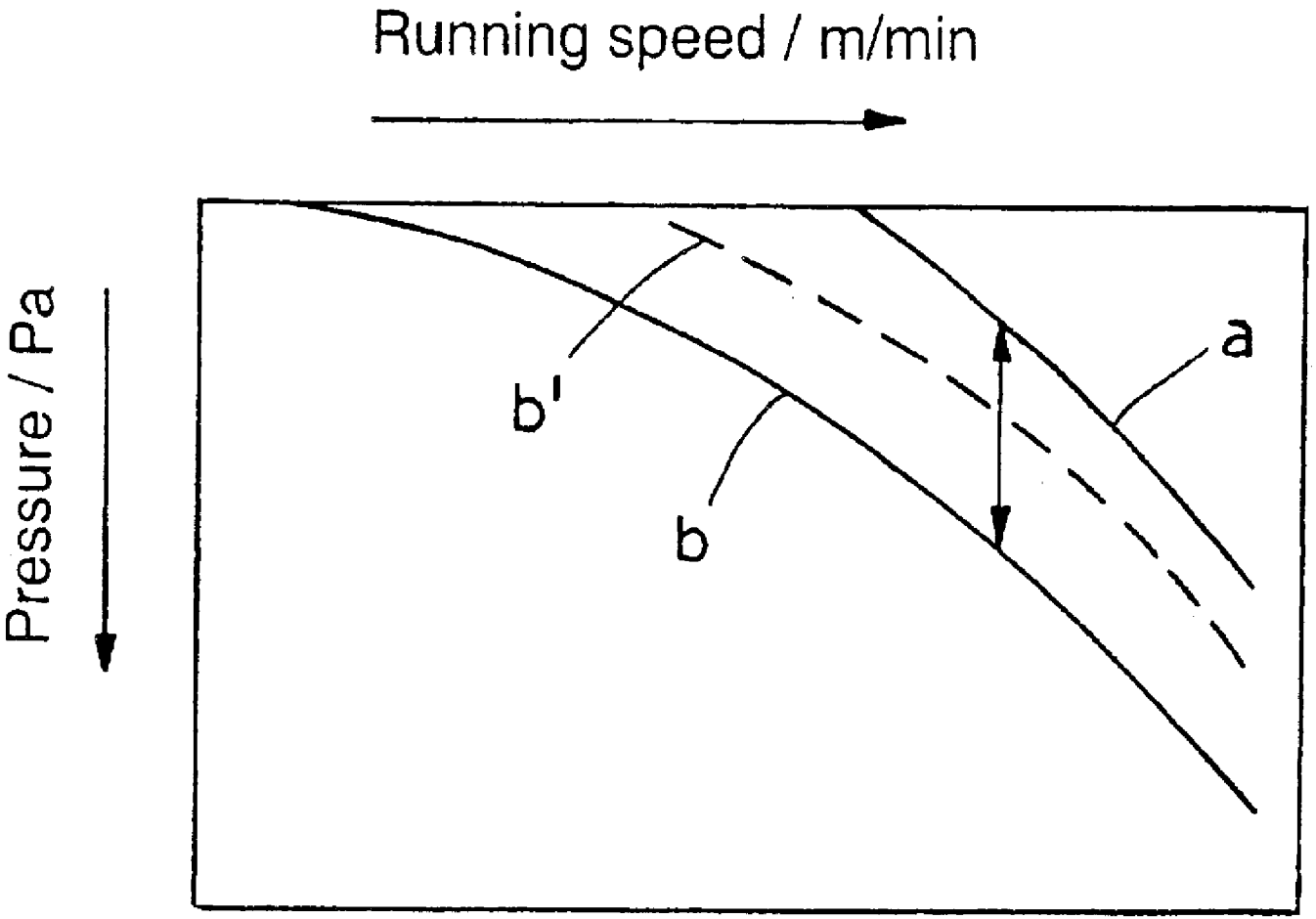
FIG. 11 shows a table which presents how the required negative pressure depends on the machine speed.

FIG. 11 is a table which as an example shows those negative pressure limits at different machine speeds which enable a good runability. The curve a represents a case where the running conditions are good, and where a relatively small constant negative pressure is required to achieve a good runability. The curve b represents a case where the running conditions are bad, but however, where a relatively high negative pressure is able to provide a good runability. The curve b' represents a situation where some running conditions are good and some are bad, and where a suitably increased negative pressure provides a good runability despite the bad conditions. If the running conditions are very bad, it is still possible in some cases, i.e. depending on which running conditions are bad, to achieve a good runability also below the curve b by increasing the negative pressure, but this is not possible in all cases. Often the running conditions are such that the negative pressure should be controlled to be somewhere between the curves a and b.

In the intensified negative pressure region the negative pressure is controlled by control means according to a measured or in some other manner determined varying parameter, such as the speed, the dry solid contents, the difference in the draw, or the web tension. The measurement information for observing the need for control and for setting the correct control level can be obtained to the control device e.g. from the process information. On the other hand, the need for control can also be observed by ocular inspection. For instance, a decreased web tension can often be detected by ocular inspection.

According to the invention the negative pressure levels can be controlled e.g. so that a desired difference in the draw, e.g 3%, is obtained at the press, whereby the paper characteristics can be optimised according to the needs of further processing.

The invention is not intended to be limited to the above presented exemplary embodiments, but the invention is intended to be widely applicable within the scope defined in the claims presented below. Thus the invention is not intended to be limited to relate to the improvement of the runability only in a drying section. The invention can also find application for other objects, such as in guiding the web from the press to the drying section.

The intensified negative pressure region can extend across the web, or only over a part of the web in its transversal direction. The intensified negative pressure region can be arranged e.g. only at the edge regions of the web, or only on the front side in the threading region. In addition to the control of the negative pressure in the intensified negative pressure region according to the running conditions, it is possible to control it differently at different locations of the web in the transversal direction of the web.

What is claimed is:

1. A method in a papermaking machine comprising the steps of:

conveying a web, supported by a fabric over a first cylinder, wherein the web is between the first cylinder and the supporting fabric, the fabric having a first side adjacent the web, and a second side opposite the web;

guiding the web supported by the fabric from an opening nip defining a disengaging point between the supporting fabric and the first cylinder, toward a roll, thus forming a web run between said first cylinder and said roll;

supporting the web run from the opening nip, toward said roll by creating a negative pressure region on the fabric second side, the negative pressure being divided into a intensified negative pressure region close to the disengaging point between the supporting fabric and the first cylinder, and a less intense negative pressure region spaced from the disengaging point;

increasing and decreasing the negative pressure in the intensified negative pressure region according to a function which is based on at least one parameter which acts on the runability of the web and which varies during the run, the at least one parameter chosen from the group consisting of:

the web pulp composition, the web grammage, the web porosity, the web tension, the first cylinder temperature, so that a desired runability is maintained between the cylinder and the roll.

2. The method of claim 1, wherein the negative pressure in the intensified negative pressure region is greater than 500 Pa, and less than 20,000 Pa, and the pressure in the less intense negative pressure region is between 10 and 700 Pa.

3. The method of claim 1, wherein the negative pressure in the intensified negative pressure region is greater than 1,000 Pa, and less than 10,000, Pa, and the pressure in the less intense negative pressure region is between 200 and 300 Pa.

4. The method of claim 1, wherein the first cylinder is in a drying section of the papermaking machine and wherein the web is guided from the first cylinder to the roll which redirects the travel of the web, and wherein the negative pressure in the intensified negative pressure region is higher than the negative pressure which is drawn on a surface of the roll.

5. The method of claim 1, wherein the negative pressure is controlled in the intensified negative pressure region so that a desired difference in web tension is obtained between a drying section and a press section in order to optimise the web characteristics.

6. The method of claim 1, wherein the intensified negative pressure region extends about 40 to about 140 mm, and no more than 300 mm from the disengaging point, in the direction of web travel.

7. The method of claim 1, wherein the intensified negative pressure region extends about 40 mm to about 100 and no more than 300 mm from the disengaging point, against the direction of web travel.

8. The method of claim 1, wherein in the drying section the travel of the web is supported by the intensified pressure region when the web has a dry solids content of less than 65%.

9. The method of claim 1, wherein the travel of the web is supported in the intensified negative pressure region by a negative pressure, which is higher the lower the strength of the web is.

10. The method of claim 1, wherein the travel of the web is supported in the intensified negative pressure region by a negative pressure, which is higher the less chemical pulp the web contains.

11. The method of claim 1, further including cylinders positioned at the beginning of a multiplicity of drying cylinders forming a drying section over which the web and the fabric are wrapped to form a multiplicity of opening nips defining a multiplicity of disengaging points between the supporting fabric and the multiplicity of dryer cylinders, each opening nip associated with one of said first cylinders, having a related intensified negative pressure region, wherein the cylinders, are threaded full width, with the aid of the intensified negative pressure regions associated with the cylinders positioned at the beginning of said multiplicity of first cylinders.

12. The method of claim 11, wherein during the threading with full width, there is used a more intense pressure in the intensified negative pressure regions than during a normal run or a web break.

13. The method of claim 1, wherein the travel of the web is supported by an intensified negative pressure generated mainly at the opening nip of each drying cylinder in a drying section, where drying of a web formed from weak pulp is taking place.

14. The method of claim 1 wherein a blow box is arranged on the second side of the supporting fabric to generate said intensified negative pressure region and air is ejected away from the intensified negative pressure region by at least one ejection nozzle arranged in the blow box at the upstream side of the intensified negative pressure region, and that air is prevented from flowing to the intensified negative pressure region by a throttling means arranged at the output side of the intensified negative pressure region in the blow box.

15. The method of claim 14, wherein additionally, air is sucked from the intensified negative pressure region by means creating suction arranged in the blow box at the intensified negative pressure region.

16. The method of claim 1, wherein the first drying cylinder is part of a drying section and wherein a blow box is arranged on that side of the supporting fabric which is opposite to the web, to generate said intensified negative pressure region between the supporting fabric and the blow box, wherein;

air is sucked away from the intensified negative pressure region by means arranged in the blow box at the intensified negative pressure region, and, wherein;

air is prevented from flowing to the intensified negative pressure region by a throttling means arranged in the blow box at the downstream and upstreamed sides of the intensified negative pressure region.

17. The method of claim 1 wherein the roll is a turn roll.

18. The method of claim 1 wherein the roll is a second drying cylinder.

19. The method of claim 1 wherein the roll is a suction roll.

20. A device in the drying section of a paper machine comprising:

a drying section having at least one drying cylinder;

a supporting fabric;

a roll, downstream of the drying cylinder for redirecting the travel of the supporting fabric;

means for conveying a web which is supported by the supporting fabric over said at least one drying cylinder, the web being between the at least one drying cylinder and the supporting fabric;

means for guiding the web from an opening nip between said cylinder and the supporting fabric toward said roll when supported by the supporting fabric, and means for creating a negative pressure which supports the travel of the web on that side of the web which is opposite the supporting fabric, when the web passes from the opening nip to said roll, the means for creating a negative pressure creating an intensified negative pressure in a region which covers the disengaging point between the supporting fabric and the drying cylinder, and a lesser negative pressure in a region which is at a distance from the disengaging point, a control means for increasing and decreasing the negative pressure in said intensified negative pressure region according to at least one parameter which acts on the runability of the web and which is varied during the run, the at least one parameter being selected from the group consisting of:

the web pulp composition, the web grammage, the web porosity, the web tension, the drying cylinder temperature; and so that a selected runability is maintained between the cylinder and the roll.

21. The device of claim 20, wherein the means for creating the negative pressure supporting the travel of the web comprises a blow box, the blow box having an injection nozzle positioned upstream of the intensified negative pressure region, to eject air away from between the blow box and the supporting fabric, and wherein the blow box incorporates a throttling means, downstream of the intensified pressure region for preventing air from flowing into the intensified pressure region.

22. The device of claim 4, further comprising means positioned in the blow box between said injection nozzle and the throttling means for connecting the intensified negative pressure region to means for creating a negative pressure.

23. The device of claim 20, wherein the means for creating a negative pressure for supporting the travel of the web comprise a suction box, which in the intensified negative pressure region is connected to a means for providing a negative pressure between the suction box and the supporting fabric, and in which, at an upstream border and a downstream border of the intensified negative pressure region, there are arranged seas for preventing air from flowing into the intensified negative pressure region.

24. The device of claim 23, wherein the seals arranged at the upstream border of the intensified negative region comprise ejection nozzles which eject air away from the intensified negative pressure region.

25. The device of claim 20, wherein the negative pressure in the intensified negative pressure region is >500 Pa, but <20000 Pa.

26. The device of claim 20, wherein the intensified negative pressure region is created in a region which extends from a disengaging point defined by the opening nip between the supporting fabric and the drying cylinder no more than 300 mm downstream of the disengaging point, and no more than 300 mm upstream of the disengaging point.

27. The device of claim 26, wherein the intensified negative pressure region is created in a region which extends from the disengaging point defined by the opening nip between the supporting fabric and the drying cylinder about 40 to about 140 mm downstream of the disengaging point and about 40 mm to about 100 mm upstream of the disengaging point.

28. The device of claim 20, wherein the control means comprises means far controlling the negative pressure in the intensified negative pressure region according to a speed obtained by measurement of web velocity.

29. The device of claim 20, wherein the control means comprises means for controlling the negative pressure in the intensified negative pressure region according to the web tension obtained by measurement.

30. The device of claim 20, wherein the device is arranged in the drying section of a paper machine provided with a twin wire run.

31. The device of claim 20, wherein the device is arranged in the drying section of a paper machine provided with a single wire run.

32. The device of claim 20 wherein the roll is a turn roll.

33. The device of claim 20 wherein the roll is a second drying cylinder.

34. The device of claim 20 wherein the roll is a suction roll.

* * * * *

UNITED STATES PATENT AND TRADEMARK OFFICE

CERTIFICATE OF CORRECTION

PATENT NO. : 6,910,282 B1
DATED : June 28, 2005
INVENTOR(S) : Reijo Jokinen et al.

It is certified that error appears in the above-identified patent and that said Letters Patent is hereby corrected as shown below:

Column 18,
Line 61, "The device of claim 4," should be -- The device of claim 21, --.

Signed and Sealed this

Twenty-third Day of August, 2005

JON W. DUDAS
*Director of the United States Patent and Trademark Office*